US005664658A

United States Patent [19]

Luo et al.

[11] Patent Number: 5,664,658

[45] Date of Patent: Sep. 9, 1997

[54] SWITCH ASSEMBLY FOR A COIN COLLECTOR

[75] Inventors: Jenny Luo; Kuo Ming Chen, both of Taipei Hsien, Taiwan

[73] Assignee: Shin Jiuh Corp., Taipei Hsien, Taiwan

[21] Appl. No.: 642,693

[22] Filed: May 3, 1996

[51] Int. Cl.[6] ..... H01H 3/04

[52] U.S. Cl. ..... 194/244; 200/335

[58] Field of Search ..... 194/244, 242, 194/231, 221; 200/47, 335, DIG. 3

[56] References Cited

U.S. PATENT DOCUMENTS

| | | | |
|---|---|---|---|
| 2,805,299 | 9/1957 | Cherry | 194/244 X |
| 3,480,752 | 11/1969 | Cherry et al. | 200/335 |
| 4,081,643 | 3/1978 | Kuo | 200/335 X |

*Primary Examiner*—F. J. Bartuska
*Attorney, Agent, or Firm*—Hoffmann & Baron, LLP

[57] ABSTRACT

A switch assembly of a coin collector includes a switch housing provided with first and second electrical contacts therein, a movable lever mounted in the housing and movable between an open position in which the lever contacts the first contact, and a closed position in which the lever contacts the second contact, and a ring secured within an opening in the housing. A sleeve extends through and is press-fitted within the ring in such a manner that the sleeve cannot rotate in the ring. The sleeve has an end wall with a central hole which is formed therethrough and which has a circular section and a radial extension extending radially and outwardly from the periphery of the circular section. A rotating unit includes a rotating shaft journalled in the sleeve, a radially extending push plate formed integrally with the inner end portion of the shaft, and a radially extending push needle fixed on the outer end portion of the shaft. A limiting device limits the shaft and the push plate to rotate in the housing within an angle. Assembly of the shaft and the sleeve can be removed forcibly from the ring such that the shaft can be rotated within the sleeve to register the push plate with the radial extension of the central hole of the sleeve, thereby permitting removal of the shaft from the sleeve.

2 Claims, 5 Drawing Sheets

SWITCH ASSEMBLY FOR A COIN COLLECTOR

BACKGROUND OF THE INVENTION

1. Field of the Invention

The invention relates to a switch assembly, more particularly to a switch assembly for use in a coin collector of a public telephone or an automatic vending machine.

2. Description of the Related Art

Referring to FIGS. 1 and 2, a conventional switch assembly is adapted to be fixed within a coin collector of a public telephone or an automatic vending machine and includes a switch housing 10, a rotary lever 141, a coiled spring 143, a mounting ring 19, a rotating unit 12, and a limiting device.

As illustrated, the switch housing 10 has a first contact 15 and a second contact 16 installed therein, and an opening 10A formed through a wall of the housing 10. As illustrated, the left end of the rotary lever 141 is biased by the spring 143 to locate at a pivot point in a recess of the wall of the housing 10, so that the rotary lever 141 is rotatable between an open position in which a movable lever 142 coupled with the rotary lever 141 by the spring 143 contacts electrically the first contact 15, and a closed position in which the movable lever 142 contacts electrically the second contact 16. The spring 143 biases the rotary lever 141 to rotate in a direction in the housing 10 so that the movable lever 142 contacts the second contact 16. The mounting ring 19 is fixed within the opening 10A formed through the wall of the housing 10. The rotating unit 12 includes a rotating shaft 120 journalled within the ring 19, a push plate 121 formed integrally with the inner end portion of the shaft 120, and a radially extending push needle 11 mounted securely on the outer end portion of the shaft 120. The limiting device includes a limiting metal plate 122 which is secured to the outer end portion of the shaft 120 and which has a stop element 123 projecting integrally and outwardly from the periphery of the plate 122. The stop element 123 is movable between two projections 181 which are provided on the wall of the housing 10.

Referring to FIGS. 1, 2 and 3, the push needle 11 can be struck and rotated by a coin dropped from an upper end portion of the coin collector so that the push plate 121 rotates the rotary lever 141. Rotation of the rotary lever 141 moves the movable lever 142 away from the second contact 16 to contact the first contact 15.

During assembly, after being placed into the housing 10 through the ring 19, the push plate 121 is rotated in the housing 10 so as to be deflected from the radial extension 191 of the central bore 190 of the ring 19, thereby preventing separation of the shaft 120 from the ring 19.

The stop element 123 is then pressed and bent toward the wall of the housing 10 by means of a hammer, in order to move from the straight position of FIG. 4 to the bent position of FIG. 5 so as to limit the stop element 123 between the projections 181. In this way, the push plate 121 (see FIG. 2) rotates the rotary lever 141 between the open position and the closed position. It requires special skill to hammer the stop element 123 into the bent position, thereby resulting in inconveniences during assembly.

SUMMARY OF THE INVENTION

The object of this invention is to provide a switch assembly for a coin collector which is easy to assemble, so as to reduce the assembly time and manufacturing cost.

Accordingly, the switch assembly of this invention is adapted to be fixed in a coin collector and includes a switch housing, a movable lever, a spring, a mounting ring, a sleeve, a rotating unit, and a limiting device. The housing has an opening formed through a wall thereof, and first and second contacts installed in the housing. The movable lever is mounted movably in the housing and is movable between an open position in which the movable lever contacts electrically the first contact, and a closed position in which the movable lever contacts electrically the second contact. The spring biases the lever to move to the closed position. The ring is secured within the opening of the housing. The sleeve extends through and is press-fitted within the ring in such a manner that the sleeve cannot rotate in the ring. The sleeve has an end wall with a central hole which is formed therethrough and which is provided with a circular section and a radial extension extending radially and outwardly from the periphery of the circular section. The rotating unit includes a rotating shaft extending through the sleeve, a radially extending push plate formed integrally with the inner end portion of the shaft and located outside and adjacent to the sleeve in such a manner that the push plate is deflected from the radial extension of the central hole of the sleeve, and a push needle which is mounted securely on the outer end portion of the shaft and which extends radially from the shaft. The needle can be struck and rotated by a coin dropped from the upper end portion of the coin collector so that the push plate activates the movable lever to move away from the second contact to contact the first contact. The limiting device includes a limiting plate secured to the outer end portion of the shaft. One of the limiting plate and the ring is formed with a circumferentially extending guideway while the other one of the limiting plate and the ring is provided with a stop element formed integrally therewith. The stop element is movable in the guideway so as to limit the shaft and the push plate to rotate within an angle within which the lever can move between the open position and the closed position and within which the push plate is deflected from the radial extension of the central hole of the sleeve so as to prevent separation of the shaft from the sleeve.

When desired, assembly of the rotating shaft and the sleeve can be removed forcibly from the ring so that the shaft can be rotated an angle within the sleeve to register the push plate with the radial extension of the central hole of the sleeve. At this time, removal of the shaft from the sleeve is permitted by passing the push plate through the circular section and the radial extension of the central hole of the sleeve.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENT

Figure 1:
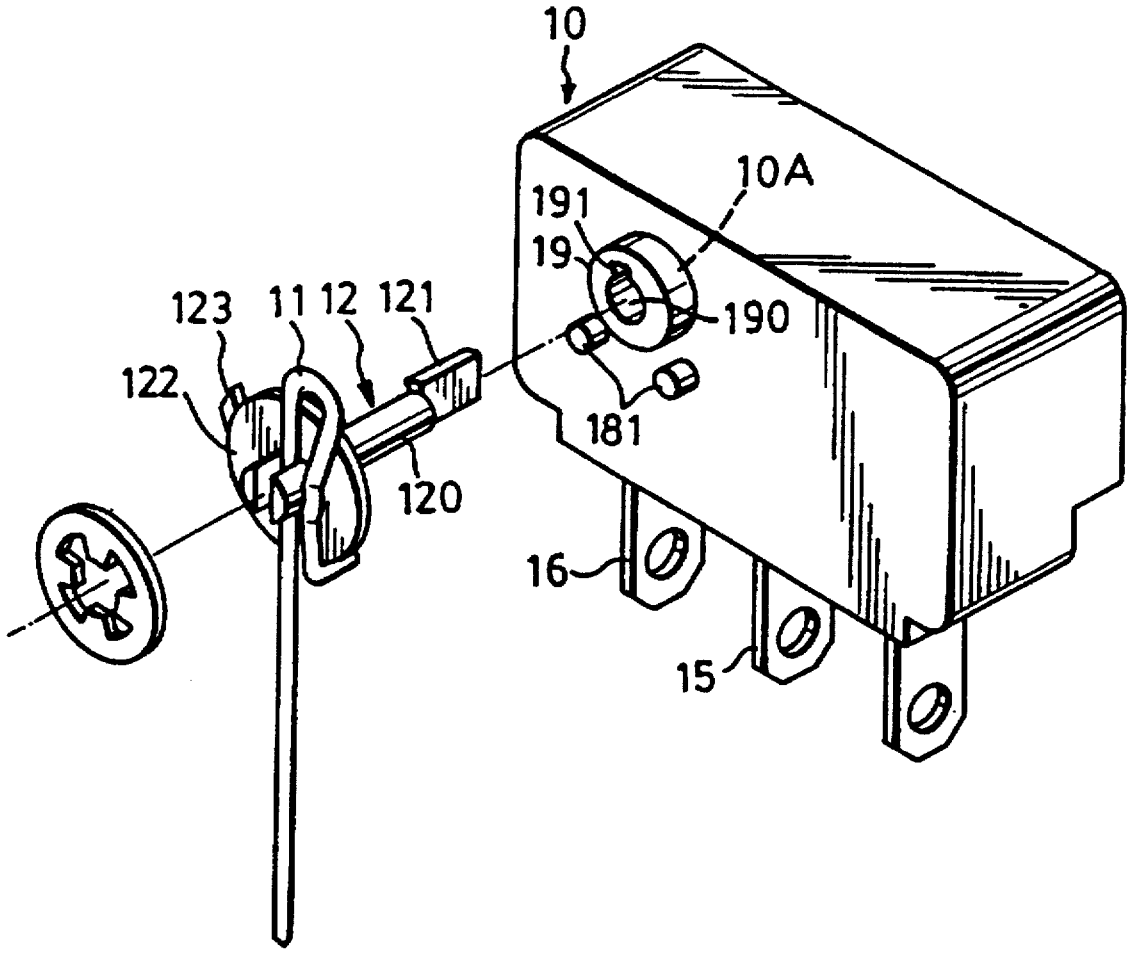
FIG. 1 PRIOR ART
FIG. 1 is an exploded view of a conventional switch assembly which is adapted to be fixed in a coin collector.
Figure 2:
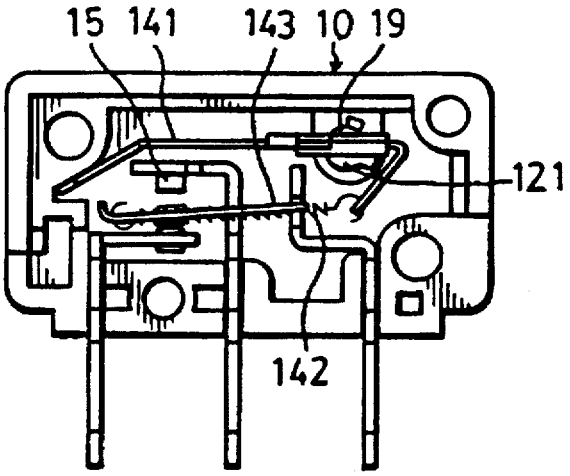
FIG. 2 PRIOR ART
FIG. 2 is a schematic view of the conventional switch assembly of this invention, illustrating the interior thereof.
Figure 3:
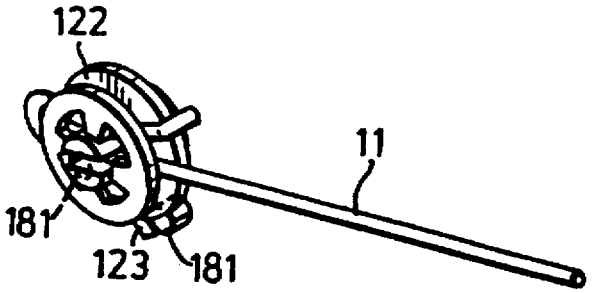
FIG. 3 PRIOR ART
FIG. 3 is a perspective view of a push needle of the rotating unit of the conventional switch assembly of a coin collector.
Figure 4:
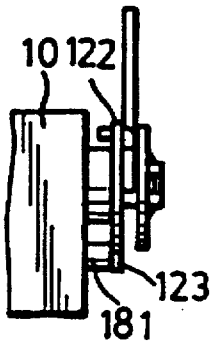
FIG. 4 PRIOR ART
FIG. 4 illustrates how the rotating unit shown in FIG. 3 is inserted into the switch housing of the conventional switch assembly of a coin collector.
Figure 5:
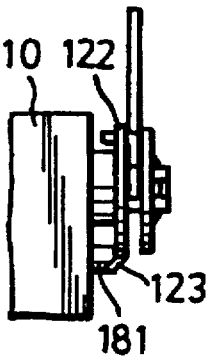
FIG. 5 PRIOR ART
FIG. 5 illustrates how the push needle of the rotating unit of the conventional switch assembly is limited between two positions.
Figure 6:
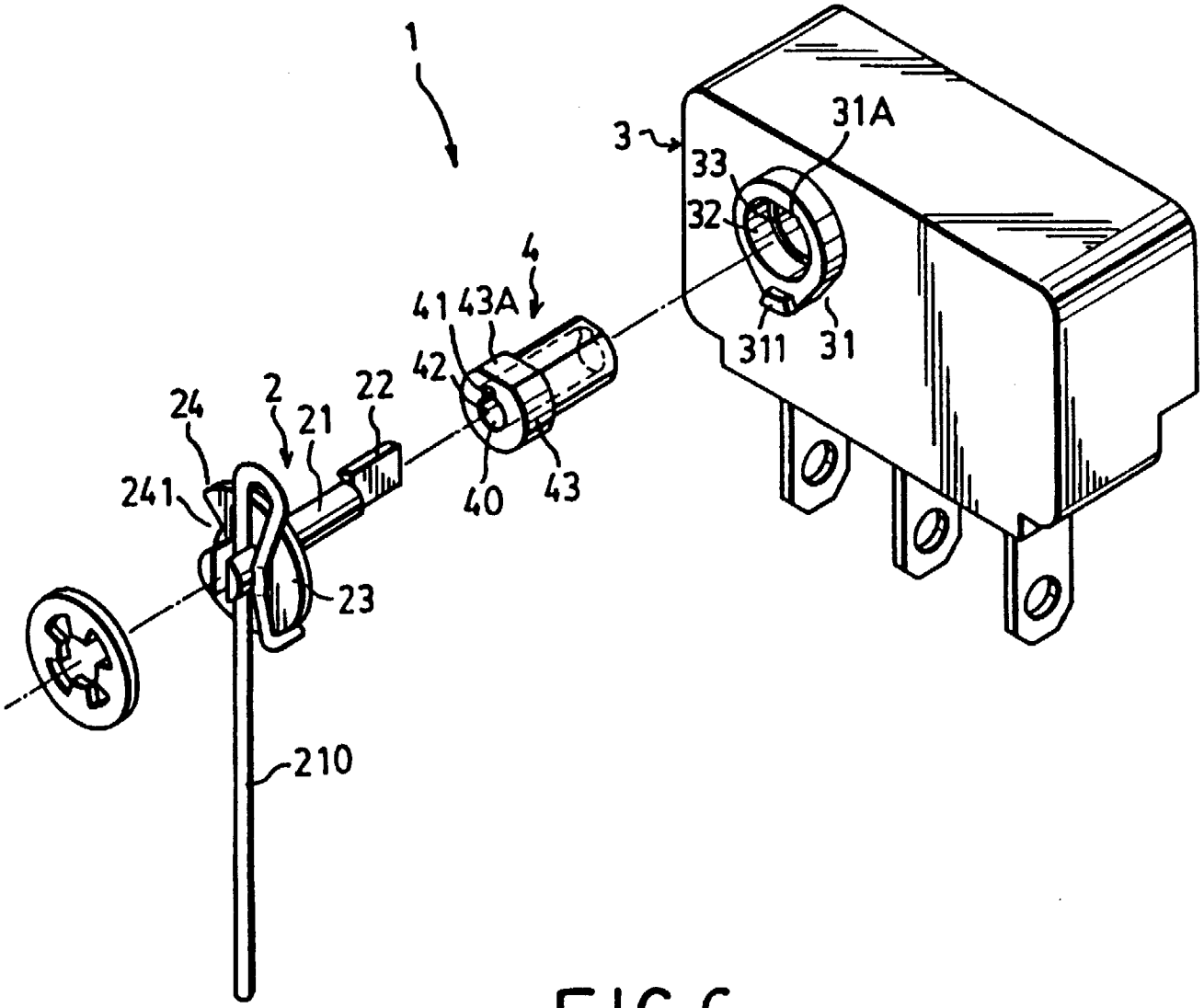
FIG. 6 is an exploded view of a switch assembly of this invention which is adapted to be fixed in a coin collector.
Figure 7:
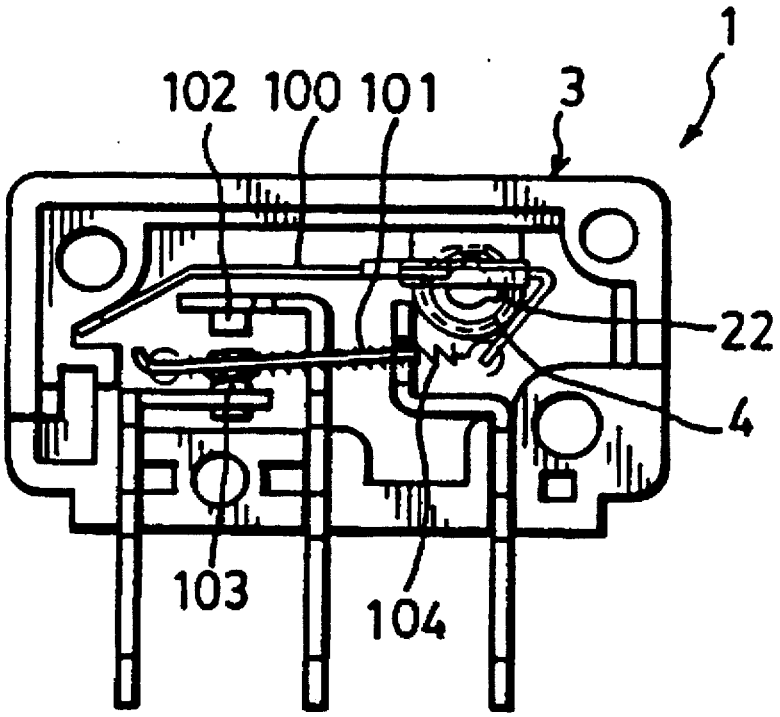
FIG. 7 is a schematic view of the switch assembly of this invention, illustrating the interior thereof.
Figure 8:
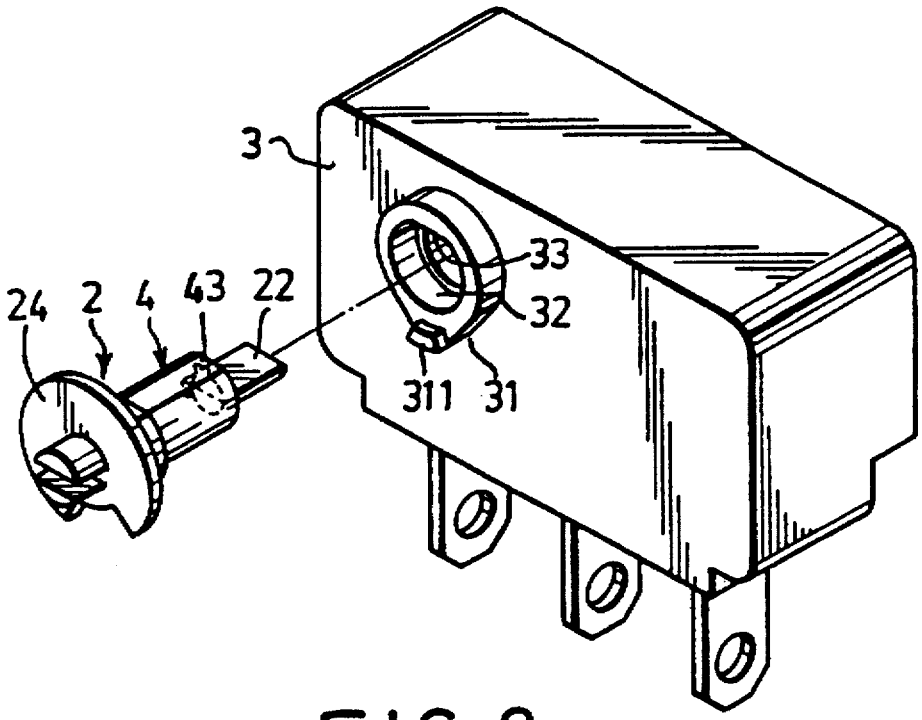
FIG. 8 illustrates how a rotating unit is inserted into the switch housing of the switch assembly of this invention.
Figure 9:
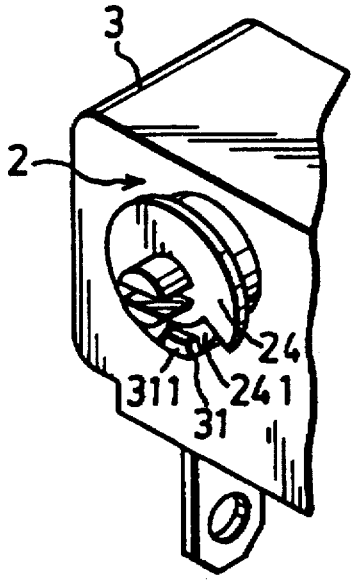
FIG. 9 is a perspective view of a portion of the switch assembly of this invention, illustrating how the rotating unit is limited between two angular positions.
Figure 10:
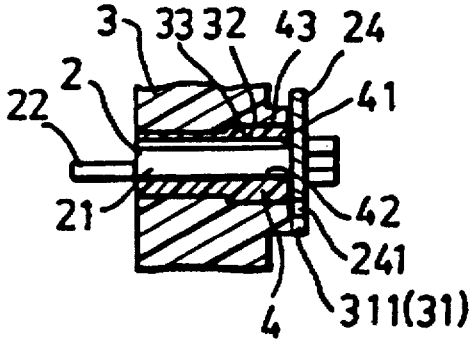
FIG. 10 is a sectional view of a portion of the switch assembly of this invention.

Referring to FIGS. 6 and 7, the switch assembly 1 of this invention is adapted to be fixed within a coin collector of a public telephone and includes a switch housing 3, a rotary lever 100, a coiled spring 104, a mounting ring 31, a tubular sleeve 4, a rotating unit 2, and a limiting device.

The housing 3 has an opening 33 formed through a wall thereof, and first and second electrical contacts 102, 103 installed in the housing 3. The rotary lever 100 is mounted rotatably in the housing 3 and is rotatable between a closed position in which a movable lever 101 coupled with the rotary lever 100 by the spring 104 contacts electrically the second contact 103, and an open position in which the movable lever 101 contacts electrically the first contact 102. The spring 104 biases the rotary lever 100 to rotate in a direction in the housing 3 so as to move the movable lever 101 to the closed position in which the movable lever 101 contacts the second contact 103. The levers 100, 101 are provided in the housing 3 in a known manner. The ring 31 is secured within the opening 33 of the housing 3. The enlarged portion 43 of the sleeve 4 extends through and is press-fitted within the ring 31. The enlarged portion 43 has an end wall with a central hole 40 which is formed therethrough and which is provided with a circular section 42 and a radial extension 41 extending radially and outwardly from the periphery of the circular section 42. Since the flat face 43A of the sleeve 4 abuts on the flat surface 31A of the ring 31, the sleeve 4 is prevented from rotating in the ring 31.

The rotating unit 2 includes a rotating shaft 21 extending through the sleeve 4, a radially extending push plate 22 formed integrally with the inner end portion of the shaft 21 and located outside and adjacent to the sleeve 4, and a radially extending push needle 210 which is mounted securely on the outer end portion of the shaft 21 and which extends radially from the shaft 21.

The limiting device includes a generally circular plate 24 which is formed with a circumferentially extending peripheral notch 241, and a stop element 311 provided on a peripheral portion of the ring 31 so as to be movable in the notch 241. The notch 241 serves as a guideway so as to limit the shaft 21 and the push plate 22 to rotate within an angle within which the movable lever 101 can move between the open position and the closed position and within which the push plate 22 is deflected from the radial extension 41 of the central hole 40 of the sleeve 4 so as to prevent separation of the shaft 21 from the sleeve 4.

As illustrated in FIGS. 6 to 10, during assembly of the switch assembly of this invention, after being placed into the housing 3 through the sleeve 4, the push plate 22 is rotated an angle in the housing 3 so as to be deflected from the radial extension 41 of the central hole 40 of the sleeve 4, thereby preventing separation of the shaft 21 from the sleeve 4. The sleeve 4 is then press-fitted into the central bore 32 of the ring 31, so that the stop element 311 extends into the notch 241 so as to limit the shaft 21 and the push plate 22 to rotate within the angle. Accordingly, the movable lever 101 can move between the open position and the closed position in a known manner. The push plate 22 is deflected from the radial extension 41 of the central hole 40 of the sleeve 4 so as to prevent separation of the shaft 21 from the sleeve 4.

When desired, the assembly of the shaft 21 and the sleeve 4 can be removed forcibly from the ring 31 so that the shaft 21 can be rotated within the sleeve 4 to register the push plate 22 with the radial extension 41 of the central hole 40 of the sleeve 4. In this way, the shaft 21 can be removed from the sleeve 4 by passing the push plate 22 through the circular section 42 and the radial extension 41 of the central hole 40 of the sleeve 4.

With this invention thus explained, it is obvious to those skilled in the art that various modifications and variations can be made without departing from the scope and spirit thereof. It is therefore intended that this invention be limited only as in the appended claims.

I claim:

1. A switch assembly for a coin collector, comprising:

a switch housing adapted to be fixed in said coin collector and having a first contact and a second contact which are installed therein, said housing further having a wall through which an opening is formed;

a movable lever mounted movably in said housing and movable between an open position in which the lever contacts electrically said first contact, and a closed position in which the lever contacts electrically said second contact;

a spring biasing said lever to move to the closed position;

a mounting ring secured within said opening of said housing;

a sleeve extending through and press-fitted within said ring in such a manner that the sleeve cannot rotate in said ring and having an end wall with a central hole which is formed therethrough and which is provided with a circular section and a radial extension extending radially and outwardly from a periphery of said circular section;

a rotating unit including a rotating shaft which extends through said sleeve and which has an inner end portion located in said housing and an outer end portion located outside said housing so that said rotating shaft is journalled within said sleeve, a radially extending push plate formed integrally with the inner end portion of said shaft and located outside and adjacent to said sleeve in such a manner that said push plate is deflected from said radial extension of said central hole of said sleeve, and a push needle mounted securely on the outer end portion of said shaft and extending radially from said shaft, said push needle being adapted to be struck and rotated by a coin dropped from an upper end portion of the coin collector so that said push plate activates said lever to move away from said second contact to contact said first contact, assembly of said rotating shaft and said sleeve being removable forcibly from said ring so that said shaft can be rotated within said sleeve to register said push plate with said radial extension of said central hole of said sleeve, thereby permitting removal of said shaft from said sleeve by passing said push plate through said circular section and said radial extension of said central hole; and a limiting device including a limiting plate secured to the outer end portion of said shaft, one of said limiting plate and said ring being formed with a circumferentially extending guideway while the other one of said limiting plate and said ring being provided with a stop element formed integrally therewith, said stop element being movable in said guideway so as to limit said shaft and said push plate to rotate within an angle within which said lever can rotate between the open position and the closed position and within which said push plate is deflected from the radial extension of said central hole of said sleeve so as to prevent separation of said shaft from said sleeve.

2. A switch assembly as claimed in claim 1, wherein said limiting plate is a generally circular plate which is formed with a circumferentially extending peripheral notch, said stop element being provided fixedly on a peripheral portion of said ring so as to move in said notch.

* * * * *